United States Patent [19]

Riba

[11] Patent Number: 4,747,222

[45] Date of Patent: May 31, 1988

[54] HIGH-PRESSURE STEAM FLATIRON

[76] Inventor: Günther Riba, Rosenbergstr. 26, D-5455 Hardert, Fed. Rep. of Germany, 44

[21] Appl. No.: 946,715

[22] PCT Filed: Apr. 15, 1986

[86] PCT No.: PCT/EP86/00215

§ 371 Date: Nov. 21, 1986

§ 102(e) Date: Nov. 21, 1986

[87] PCT Pub. No.: WO86/06116

PCT Pub. Date: Oct. 23, 1986

[30] Foreign Application Priority Data

Apr. 16, 1985 [DE] Fed. Rep. of Germany ..... 3513508

[51] Int. Cl.[4] ..... D06F 75/06

[52] U.S. Cl. ..... 38/77.7; 38/77.9; 219/275; 219/530

[58] Field of Search ..... 38/77.7, 77.83, 77.1, 38/82, 77.9; 219/275, 302, 530; 29/611, 613

[56] References Cited

U.S. PATENT DOCUMENTS 2,284,411 - 5/1942 Fielding ..... 38/77.9
2,573,174 10/1951 Bate ..... 38/77.7 X
3,032,861 5/1962 Foster ..... 219/530 X
3,134,182 5/1964 Morton ..... 38/77.9
3,165,844 1/1965 Swanke ..... 219/275 X
3,930,325 1/1976 Schaeffer et al. ..... 38/77.9

*Primary Examiner*—Louis K. Rimrodt
*Assistant Examiner*—J. L. Olds
*Attorney, Agent, or Firm*—Donald Brown; Robert T. Gammons

[57] ABSTRACT

A flatiron is provided with a plane plate (2) onto which a heating coil (5), a tubular coil (8) as evaporator means, and a capillary tube-sensing element (15) in a tube (14) are soldered. The bottom of the tubular coil (8) is provided with bores (12) in alignment with orifices (12) in the plane plate (2), which serve as outlet orifice for the evaporated fluid. The heating coil (5) and the tubular coil (8) are arranged in mutual heat-conducting contact. The plane plate (2) is connected to a casing element (3) and a handle (4) in a way that there will not arise any thermal bridges between the plane plate (2) and the casing or the handle, respectively. A thermostat for regulation of the temperature of the plane plate (2) is provided with a capillary tube-sensing element (15) leading to a regulating switch means arranged in the handle.

9 Claims, 4 Drawing Sheets

HIGH-PRESSURE STEAM FLATIRON

The present invention relates to a steam flatiron comprising a base element provided with the ironing bottom, and a casing element with a handle, further comprising heating means arranged above the base element, with evaporator means on the top side of the base plate, which communicate with the bottom side thereof through bores, and comprising thermostat means to regulate the adjustable temperature of the base element.

With such a flatiron, the base element is conventionally made in the form of a casting or die casting, e.g. consisting of aluminum. On its side turned away from the ironing bottom, this base element is provided with a grooved structure in which are embedded integrally cast heating means. Moreover, steam chambers open at the top are integrally molded on the base plate, for being closed by means of a cover, a gasket being required for sealing the cover from the base plate. The molding of the casting and the completion with the cover are complicated and expensive operations. Moreover, this results in a heavy weight of the flatiron. In other cases, the steam chambers are integrally cast in the ironing base. There are also flatirons in which the heating tube is directly included in a larger-size tube. The result of this design, however, is excessive steam heating since the heating system becomes very hot. To this adds that the heat transfer to the ironing plate is very bad. Furthermore, all of the afore-described solutions entail very high costs.

A bimetal regulator is provided to regulate the temperature. Its switching contact is arranged directly in the thermal flow of the hot flatiron plate so that it is highly susceptible of damage or failure.

The present invention is based on the problem of designing a flatiron of the type described by way of introduction in a manner that it will be simpler and less expensive to produce. According to an improvement of the invention, the temperature regulator means of the ironing bottom are to be so designed that its service life will be prolonged while reliability in operation will be enhanced.

This problem is solved by a flatiron of the type described by way of introduction, which, according to the present invention, is characterized by the fact that the base element is configured as a plane plate, that the heating means are designed as a heating coil attached to the plate, and that the evaporator means are designed as a tubular coil attached to the plate as well.

Further characteristics and expedient features of the present invention will result from the description of an embodiment, with reference to the drawing. In the drawing.

Figure 1:
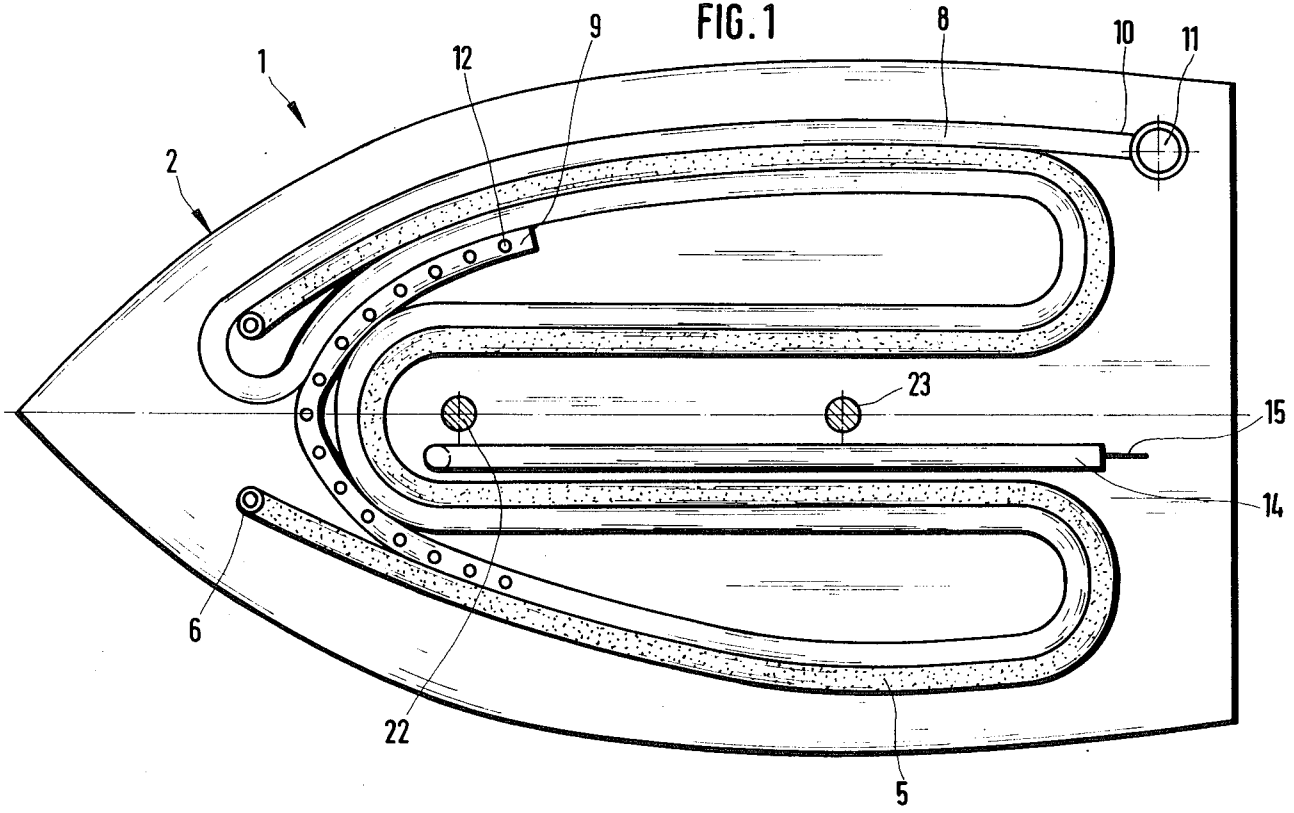
FIG. 1 is a plan view of the base element of a flatiron, with the heating and evaporator means.

The iron 1 comprises a base element in the form of a plane high-grade steel plate 2 made of VA material, and a casing 3 with a handle 4. A heating coil 5 made of VA material is soldered directly onto the plate 2 by means of a combined sintering/soldering method so as to allow for a direct heat transfer between the heating coil 5 and the plate 2. The heating coil 5 is so arranged on the plate that all areas of the plate will be uniformly heated, if possible. As proceeds from Fig. 2, the heating coil 5 is so designed that the heating effect proper stops at point 6 from where onwards the heating coil is no longer contacting the plate 2 and merely continues up to an electrical connector 7.

Another tubular coil 8 extends in parallel to the heating coil 5, which is also soldered directly to plate 2, by a combined sintering/soldering process, in a way that is contacts the heating coil 5 in areas of maximum extension possible. One end 9 of the coil 8 is closed while the other end is provided with delivery means 11 for steam inlet. The coil 8 communicates with the ironing bottom 13 of plate 2 through a plurality of respectively spaced bores or steam orifices 12 through plate 2 and coil 8. Coil 8 and heating coil 5 are also connected to each other by soldering in the contact areas so as to improve the thermal contact. The illustrated path of the tube is one possible design and may be varied by other variants following the same principle or may be adapted to the prevailing conditions, e.g. for a narrowed flatiron used to open seams.

As can best be seen in FIG. 1, moreover, a tube 14 extending over a longitudinal section of plate 2 is soldered to the plate. Thus tube is closed at one end while its other end is open. A capilary tube-sensing element 15 is introduced into the tube, which is connected to the regulating switch means 17 through a capillary tube 16 projecting from the open end.

Figure 2:
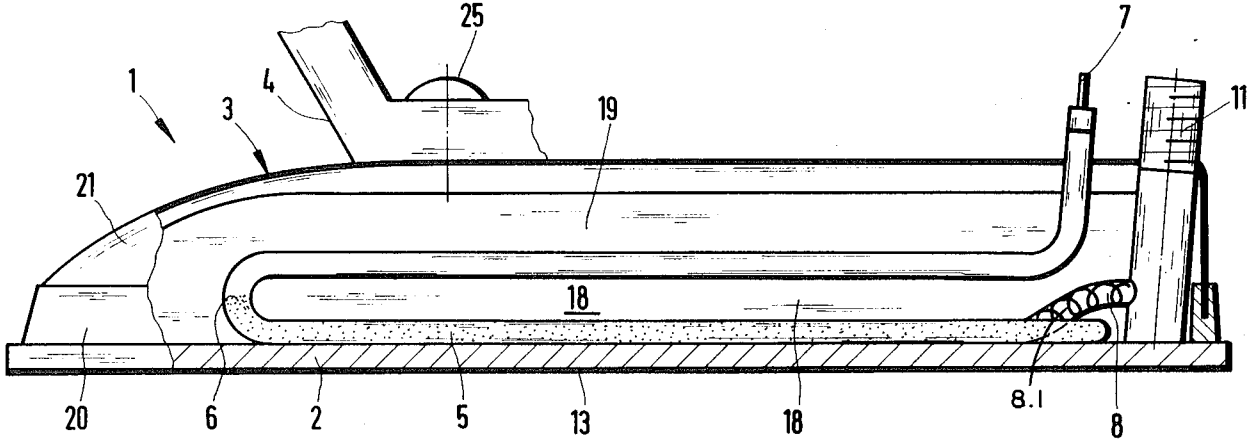
FIG. 2 is a partial side view of the base element and the casing element, with one part of the casing wall being omitted for illustration of the inside structure.
Figure 3:
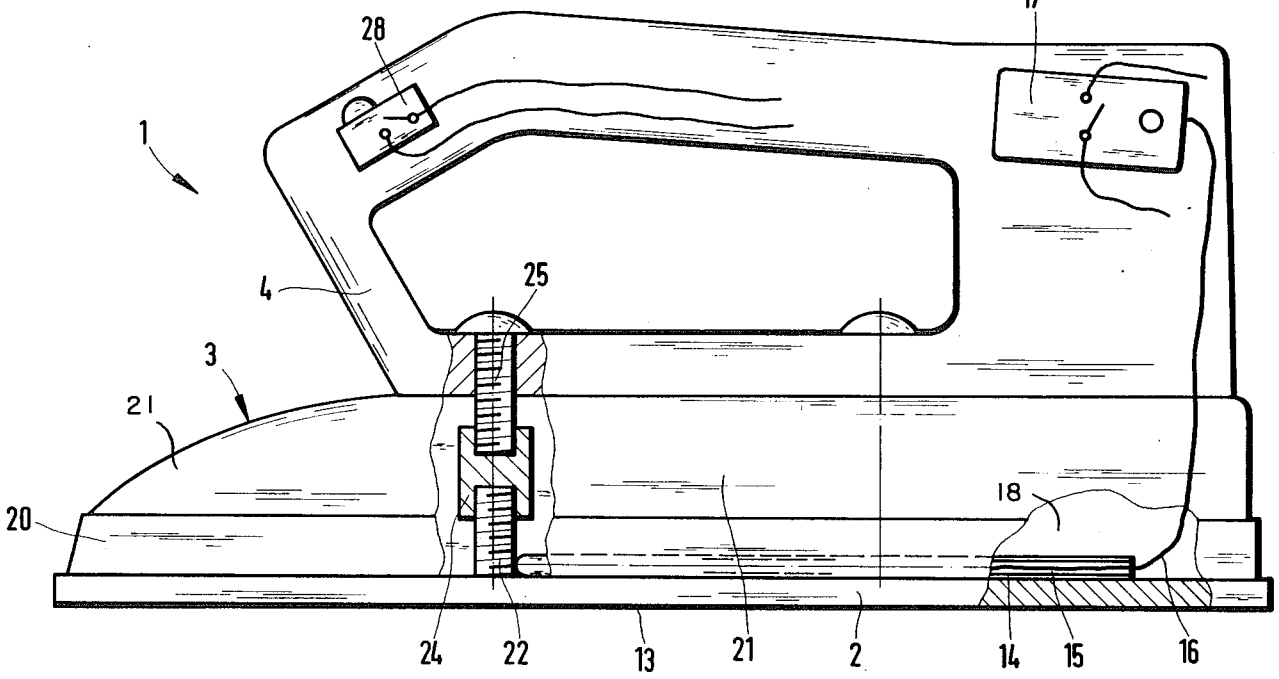
FIG. 3 is a side view of the flatiron.
Figure 4:
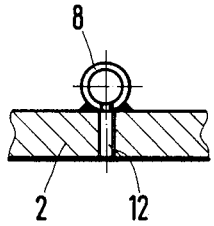
FIG. 4 shows a segment of the base element in transverse section.

As can best be taken from FIG. 2, a layer 18 of insulating material is provided immediately on that section of the heating coil 5, which is connected to plate 2. Another layer 19 of insulating material is arranged over that section of heating coil 5 which leads to the electrical connector 7 and is no longer directly heated. As is most clearly illustrated in FIG. 3, the casing 3 placed on top of plate 2 is provided with a marginal section 20, which is seated directly on the plate, as well as a hood-type section 21 which the handle 4 is attached to. The marginal section 20 is preferably made of Teflon material or any other thermally non-conductive material so that there is no direct heat transfer from plate 2 to the hood-type section 21.

Two threaded bolts 22, 23 FIG. 1 are welded to the top side of plate 2 at a spacing thereform, to connect the casing 3 with plate 2. One double nut 24 FIG. 3 each is screwed onto these threaded bolts, such nuts being made of Teflon or any other material which is thermally non-conductive. A screw 25 is passed through the handle 4 and the hood-type section 21 of casing 3 and is threaded into the counter-opening of the double nut 24 to connect the casing to the plate. Thus, the casing and the plate are fixedly attached to each other by means of the corresponding screws 25, the respective double nut 24 and the threaded bolts 22, 23. The double nuts 24 prevent the heat transfer from the plate to the casing.

Figure 5:
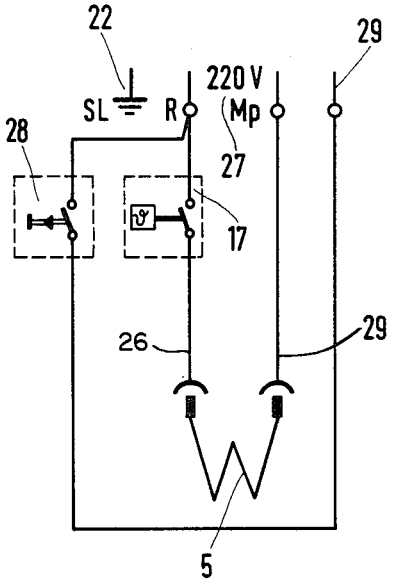
FIG. 5 illustrates the electrical wiring diagram of the flatiron.

As can best be taken from FIG. 5, one terminal post of the heating coil 5 is connected through connector means 26 to one connector of the regulating switch means 17, whereas the other post of the heating coil 5 is connected through the connector means 24 to the neutral conductor of the power supply 27. The other connector of the regulating switch means 17 is connected to the phase conductor of the power supply. Moreover, the phase conductor of the power supply is connected through a microswitch 28 to a distribution point 29 which actuates the steam supply to the steam inlet 11.

The capillary tube 16 coming from the capillary tube-sensing element 15 is connected to the regulating switch means 17. The microswitch 28 and the regulating switch means 17 are arranged in the handle, as can best be seen in FIG. 3.

In operation, when the switch of the regulating switch means 17 is closed, electric current passes through the heating coil 5. This coil or the enveloping tube is heated and transmits this heat to the plate 2, which is in direct heat-conducting contact therewith, and to the tubular coil 8 adjacent to plate 2. By means of the capillary tube-sensing element 15 and the regulating switch means 17, the temperature is adjusted to a preset value.

When the contact at the microswitch (28) is closed the steam may enter the tubular coil (8) whereupon it is passed through the steam orifices (12) of the ironing bottom and arrives at the material to be pressed. A spring made of VA steel is introduced into the steam tube so as to rest against the inner wall surface over the entire course of the tube; this spring serves to produce turbulence and evaporation of the water drops of condensation which may also be carried through the supply. With a very moist steam quality, still another spring may be introduced into the inside diameter of the spring mentioned first. Such evaporation is enhanced by the inside contact between the heating coil (5) and the tubular coil (8) as well as by the contact of these two elements together with the plate (2). Excessive heating of the steam is precluded, however, since a speedy and uninterrupted heat flow is ensured by the close connection between the tubes (5, 8) and the plate (2), so that localization of heat cannot arise.

Due to the attachment of the capillary tube-sending element 15 in the tube 14, which receives the capillary tube-sensing element and is directly connected to plate 2, a very precise temperature regulation effect can be achieved. Since the switching contact proper is located in the handle, thus being thermally insulated against the hot plate 2, the service life of the switching contact is moreover considerably prolonged.

As the tube containing the heating coil, the tubular coil 8 for the steam system, and plate 2 are all made of VA material, i.e. the same material, optimum conditions are created for mutually corresponding thermal expansion, which increases the service life.

Since due to the insulating layers 18, 19 arranged above and as a result of the thermally insulating double nuts 24, almost all of the heat produced by the heating coil 5 is transmitted to the plate 2, the pressing person is not annoyed by radiated heat while additionally the efficiency of the flatiron is increased.

As a result of the comparatively thin configuration of the botton (2), whose thickness ranges between 2 and 3 mm, and due to the heating, evaporating and temperature-sensing plane of the tubes (5, 8 and 14), which is of a very flat configuration as well as claims 8 mm approximately, a very flat and, weighing 1,200 g approximately, one of the lightest industrial flatiron in general is achieved in spite of the optimum thermal insulation.

I claim:

1. A flatiron comprising a base element configured as a plane plate with an ironing bottom; a casing element with a handle; a heating coil attached to the plane plate on top thereof; evaporator means designed as a tubular coil and attached to the plane plate on top thereof, the evaporator means communicating with the bottom side of the base element through bores; and thermostat means for regulating the adjustable temperature of the base element.

2. A flatiron according to claim 1, wherein the plane plate is of the type of a highgrade steel plate.

3. A flatiron according to claim 1, wherein the heating coil and/or the tubular coil are attached to the plane plate by soldering or welding, respectively.

4. A flatiron according to claim 1, wherein the heating coil and tubular coil are arranged in mutually adjacent relationship so that heat is directly transferred from the heating coil to the tubular coil.

5. A flatiron according to claim 1, wherein the casing element is provided with a section for thermal insulation between the base element and the portion of the casing element being remote from the base element.

6. A flatiron according to claim 1, wherein an insulating layer is arranged above the heating coil.

7. A flatiron according to claim 1, wherein the thermostat means is provided with a capillary tube-sensing element attached to the base element and a regulating switch means connected thereto through a capillary tube-sensing element arranged at the casing element or its handle, respectively, at a spacing from the base element.

8. A flatiron according to any of claims 1 to 7, characterized in that a spring is provided inside the tubular coil, said spring resting against the internal wall over the entire course of the tubular coil and said spring effecting turbulence and evaporation of water of condensation which is possible carried through the tubular coil.

9. A flatiron comprising a uniformly thick steel ironing plate defining a uniformly flat ironing surface, a casing mounted on the ironing plate and coextensive therewith defining a hollow chamber above the ironing plate, a handle mounted on top of the casing, means securing the handle and casing to the ironing plate, a heating coil mounted on the surface of the ironing plate within the chamber in heat-transmitting contact therewith, an evaporator coil mounted on the surface of the ironing plate within the chamber, said evaporating coil containing openings therein at its place of contact with the ironing plate and said ironing plate containing openings therein in communication at its inner side with the openings in the coil and at its outer side with the ironing surface of the ironing plate, said heating coil and tubular coil being arranged in mutually adjacent relationship such that the heat from the heating coil is transmitted directly to the tubular coil and wherein there is a layer of thermal insulation disposed between the coils and the casing above the coils.

* * * * *